US011255624B2

(12) United States Patent
McRorey

(10) Patent No.: US 11,255,624 B2
(45) Date of Patent: Feb. 22, 2022

(54) MUZZLE ADAPTATION SYSTEM

(71) Applicant: Jason McRorey, Midlothian, TX (US)

(72) Inventor: Jason McRorey, Midlothian, TX (US)

( * ) Notice: Subject to any disclaimer, the term of this patent is extended or adjusted under 35 U.S.C. 154(b) by 0 days.

(21) Appl. No.: 16/158,800

(22) Filed: Oct. 12, 2018

(65) Prior Publication Data

US 2019/0113296 A1 Apr. 18, 2019

Related U.S. Application Data

(60) Provisional application No. 62/571,474, filed on Oct. 12, 2017.

(51) Int. Cl.

| | |
|---|---|
| ***F41A 21/32*** | (2006.01) |
| ***F41A 21/40*** | (2006.01) |
| ***F41A 21/36*** | (2006.01) |
| *F41A 21/30* | (2006.01) |

(52) U.S. Cl.

CPC ..... *F41A 21/325* (2013.01); *F41A 21/30* (2013.01); *F41A 21/36* (2013.01); *F41A 21/40* (2013.01)

(58) Field of Classification Search

CPC ..... F41A 21/30; F41A 21/32; F41A 21/325; F41A 21/34; F41A 21/36; F41A 21/48; F41A 21/481; F41A 21/482; F41A 21/484

See application file for complete search history.

(56) References Cited

U.S. PATENT DOCUMENTS 847,911 A * 3/1907 Cory ..... F41A 21/40 42/79
1,455,661 A * 5/1923 Rhinehart ..... F41A 21/40 42/79
1,494,524 A * 5/1924 Adamson ..... F41A 21/00 89/16
2,098,617 A * 11/1937 Cutts, Jr. ..... F41A 21/40 42/79
2,153,246 A * 4/1939 Gibson ..... F41A 21/42 42/79
2,165,457 A * 7/1939 Cutts, Jr. ..... F41A 21/36 89/14.3
2,212,686 A * 8/1940 Hughes ..... F41A 21/36 89/14.3
2,345,127 A * 3/1944 Kehne ..... F41A 21/484 42/75.02
2,447,205 A * 8/1948 Powell ..... F41A 21/40 42/79
2,453,121 A * 11/1948 Cutts ..... F41A 21/36 89/14.3
2,453,747 A * 11/1948 Egleson ..... F41A 21/42 42/79
2,489,568 A * 11/1949 Ferhat ..... F41A 21/40 42/79
2,558,200 A * 6/1951 Schmeling ..... F41A 21/40 42/79
2,589,171 A * 3/1952 Vironda ..... F41A 21/40 42/79

(Continued)

*Primary Examiner* — Derrick R Morgan
(74) *Attorney, Agent, or Firm* — Leavitt Eldredge Law Firm

(57) ABSTRACT

A muzzle adaptation system facilitates the attachment of adaptors to the muzzle of a firearm. A converter is attached to the muzzle of a firearm using existing features such as threads. The adaptors are secured to the converter by a release device that allows the adaptor to be attached without precise alignment or fasteners.

2 Claims, 5 Drawing Sheets

(56) References Cited

U.S. PATENT DOCUMENTS 2,656,638 A * 10/1953 Cobb ..... F41A 21/40 42/79
2,668,479 A * 2/1954 Batten ..... F41A 21/36 89/14.3
2,894,348 A * 7/1959 Cutts ..... F41A 21/42 42/79
2,953,972 A * 9/1960 Sorensen ..... F41A 21/36 89/14.3
3,412,497 A * 11/1968 Denton ..... A63H 37/00 42/54
3,676,947 A * 7/1972 Ashbrook ..... F41A 21/40 42/79
3,797,155 A * 3/1974 Smith ..... F41A 21/42 42/79
3,971,285 A * 7/1976 Ellis ..... F41A 21/36 89/14.3
4,058,925 A * 11/1977 Linde ..... F41A 21/40 42/79
4,811,648 A * 3/1989 Blackwell ..... F41A 21/36 89/14.3
4,893,426 A * 1/1990 Bixler ..... F16B 7/20 403/299
5,325,617 A * 7/1994 Vojta ..... F41A 11/02 42/75.03
5,357,842 A * 10/1994 Reynolds ..... F41A 21/36 89/14.3
5,415,073 A * 5/1995 Ciluffo ..... F41A 21/36 89/14.2
5,433,133 A * 7/1995 La France ..... F41A 21/325 89/14.2
5,559,302 A * 9/1996 Latka ..... F41A 21/325 89/14.05
5,685,102 A * 11/1997 Latka ..... F41A 21/325 42/76.01
5,851,035 A * 12/1998 Marc ..... F16L 19/005 285/86
6,789,343 B1 * 9/2004 Dietrich ..... F41A 21/40 42/79
6,973,863 B1 * 12/2005 Jones ..... F41A 21/26 89/14.2
6,990,764 B2 * 1/2006 Walker ..... F41A 21/40 42/76.01
7,032,931 B2 * 4/2006 Austin ..... F16L 19/005 285/92
7,353,740 B1 * 4/2008 Hoffman ..... F41A 21/26 42/107
7,676,976 B2 * 3/2010 Dueck ..... F41A 21/325 42/90
8,714,300 B2 * 5/2014 Johansen ..... F41A 21/325 181/223
8,997,621 B1 * 4/2015 Dater ..... F41A 21/32 89/14.3
D737,398 S * 8/2015 Spanel ..... D22/108
9,182,187 B1 * 11/2015 Griffith ..... F41A 21/325
9,261,318 B2 * 2/2016 Wood, Jr. ..... F41A 21/325
9,513,078 B1 * 12/2016 Fulton ..... F41A 21/30
9,739,560 B1 * 8/2017 Salvador ..... F41A 21/325
9,921,021 B1 * 3/2018 Graham, II ..... F41A 21/325
9,964,376 B2 * 5/2018 Odle ..... F41A 21/325
10,082,355 B2 * 9/2018 Addis ..... F41A 21/36
10,145,637 B2 * 12/2018 Hwang ..... F41A 21/34
10,184,744 B2 * 1/2019 Young ..... F41A 21/325
2003/0019351 A1 * 1/2003 Fluhr ..... F41A 21/32 89/14.4
2010/0282056 A1 * 11/2010 Hung ..... F41A 21/34 89/14.2
2011/0197487 A1 * 8/2011 Humston ..... F41A 21/34 42/1.06
2012/0048100 A1 * 3/2012 Davies ..... F41A 21/34 89/14.2
2012/0090588 A1 * 4/2012 Chen ..... F41A 21/48 124/83
2013/0133976 A1 * 5/2013 Johansen ..... F41A 21/325 181/223
2014/0096426 A1 * 4/2014 Schafer ..... F41A 21/40 42/79
2014/0360807 A1 * 12/2014 McKenzie ..... F41A 21/30 181/223
2015/0198403 A1 * 7/2015 Bentley ..... F41A 19/10 42/75.02
2015/0204630 A1 * 7/2015 Sotiropoulos ..... F41A 21/40 42/79
2015/0253098 A1 * 9/2015 Russell ..... F41A 21/30 89/14.4
2015/0377577 A1 * 12/2015 Pappas ..... F41A 21/34 89/14.2
2016/0102935 A1 * 4/2016 Young ..... F41A 21/325 42/76.01
2017/0097205 A1 * 4/2017 Palu ..... F41A 21/30
2017/0184367 A1 * 6/2017 Odle ..... F41A 21/325
2018/0106569 A1 * 4/2018 Smith ..... F41A 21/30
2018/0142980 A1 * 5/2018 Caravaggi ..... F41G 1/02
2018/0259286 A1 * 9/2018 Westcott ..... F41A 21/40

* cited by examiner

MUZZLE ADAPTATION SYSTEM

BACKGROUND

1. Field of the Invention

The present invention relates generally to firearm systems, and more specifically, to a muzzle adaptation system for quickly altering the effects of the discharge of a firearm at the exit of the barrel.

2. Description of Related Art

Firearm systems are well known in the art and are effective means to launch a projectile. For example, FIG. 1 depicts a conventional rife 101 having a barrel 103 with a muzzle 105 and a muzzle break 113 attached thereto. The barrel 103 having a cartridge 107 positioned in its breach 109. During use, the cartridge launches a bullet 111 out of the muzzle 105 by igniting gunpowder. The gunpowder also produces exhaust gasses that also exit through the muzzle 105 and are dissipated by the muzzle break 113.

It is known in the art that placing using muzzle breaks or the like alters the performance of the firearm. One of the problems commonly associated with system 101 is it limited efficiency. For example, the muzzle break 113 is threaded to the muzzle 105 or attached through fasteners making it is difficult to change or remove the muzzle break 113.

Accordingly, although great strides have been made in the area of firearm systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
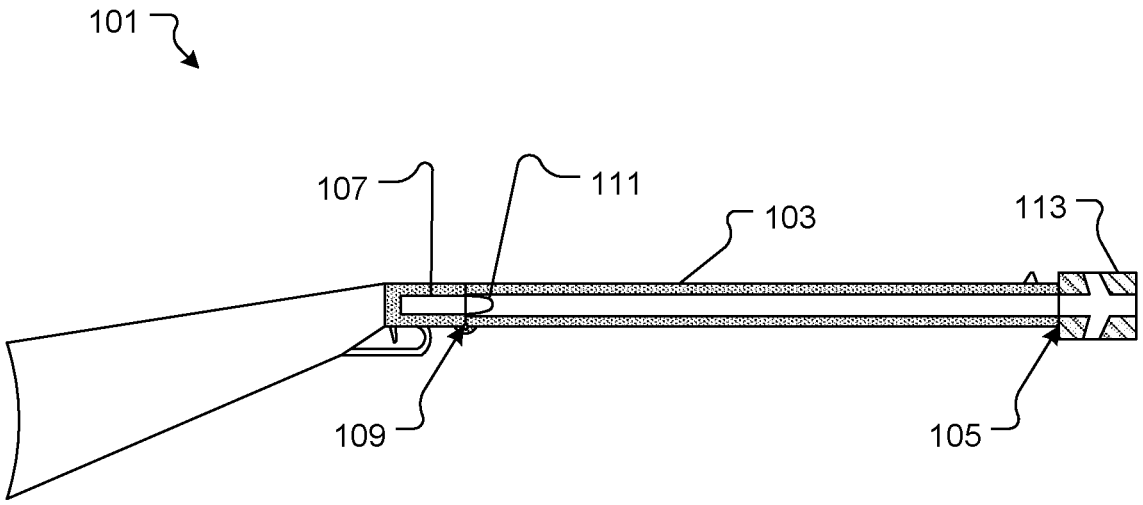
FIG. 1 Prior Art
FIG. 1 is a cross-sectional side view of a common rifle.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional firearm systems. Specifically, the invention of the present application enables the rapid change of adaptors attached to the muzzle of a firearm. This and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
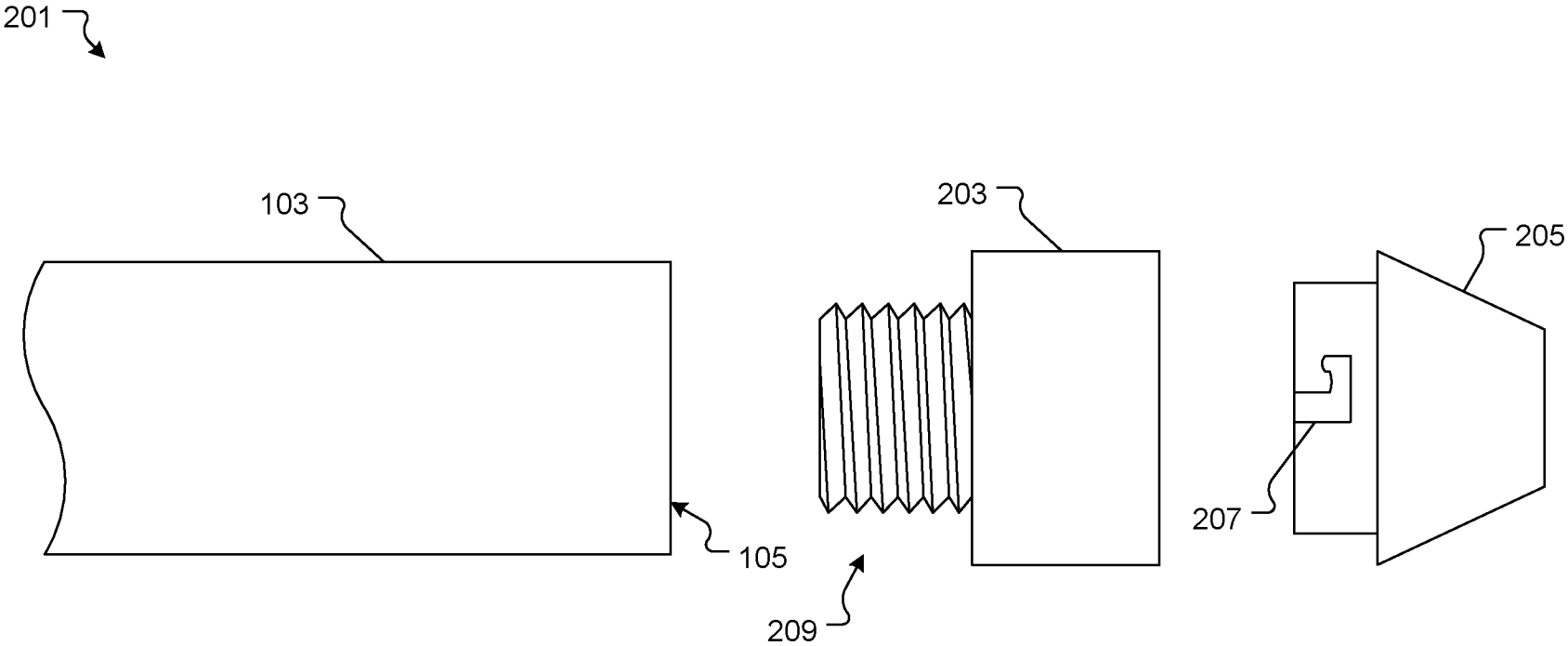
FIG. 2 is an exploded side view of a muzzle adaptation system in accordance with a preferred embodiment of the present application.

Referring now to the drawings wherein like reference characters identify corresponding or similar elements throughout the several views, FIG. 2 depicts a side view of a muzzle adaptation system in accordance with a preferred embodiment of the present application. It will be appreciated that system 201 overcomes one of more of the above-listed problems commonly associated with conventional firearm systems.

Figure 3:
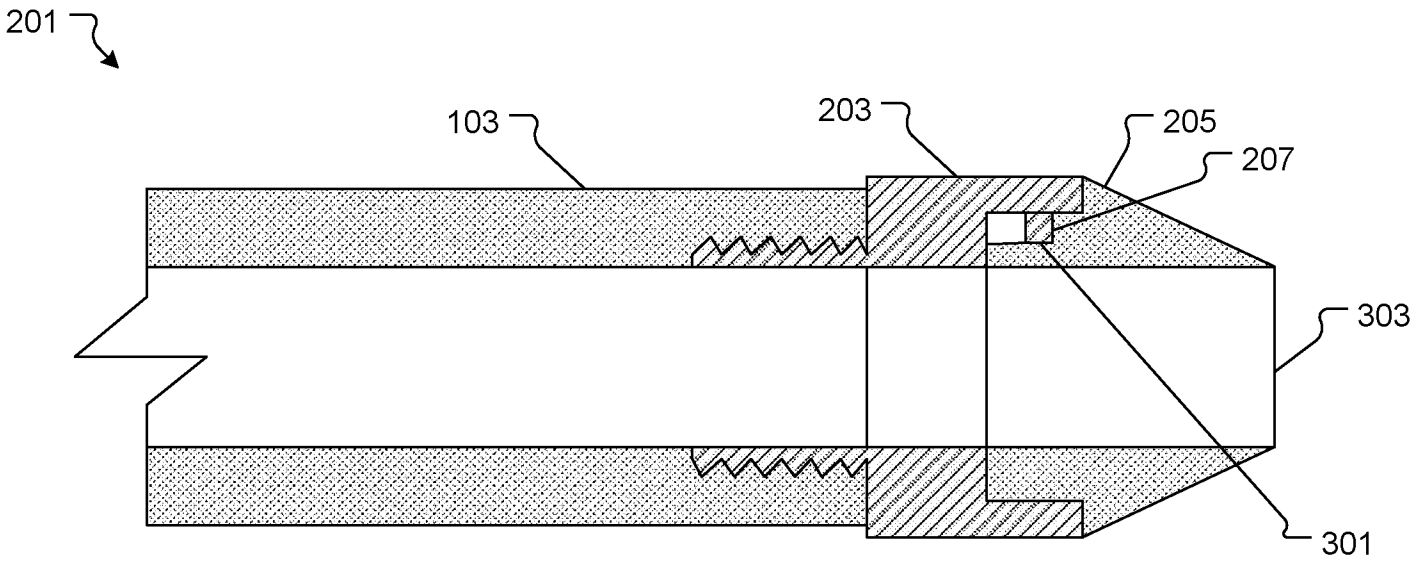
FIG. 3 is a cross-sectional top view of the system device of FIG. 2.

In the contemplated embodiment, system 201 includes a converter 203 configured to attach to the muzzle 105 of a barrel 103 of a firearm via threads 209. An adaptor 205 such as a muzzle break attaches to the converter 203 via a release device 207. In the current embodiment the release device is depicted as a slot with a retainer. As depicted in FIG. 3, the converter 203 has a pin 301 permanently attached to the inside surface and configured to enter the slot 207 of the adaptor 205. The converter 203 and adaptor 205 having a central channel 303 in line with that of the barrel 103 to allow the bullets to exit the firearm.

In use, an adaptor 205 is selected by a user and placed in the converter 203 and lock in place by aligning the pin 301 with the slot of the release device 207 and twisting so that the pin 301 enters the retainer. The firearm is used to discharge bullets. The adaptor 205 can be removed and a second adaptor is selected by the user and placed in the converter 203 as previously disclosed for the first adaptor 203.

It should be appreciated that one of the unique features believed characteristic of the present application is that converter 203 enables the rapid attachment, removal and replacement of adaptors 205 to the muzzle 105. It will also be appreciated that enabling a user to change the adaptor 203 being used allows the user to quickly modify the firearm to the conditions in which it is used.

While the current embodiment 201 depicts the release device 207 as a slot and retainer that engage with the pin 301 of the converter 203; it is contemplated that other means of quickly attaching and removing the adaptors 205 could be used. One example being a bearing or spring lock.

Figure 4:
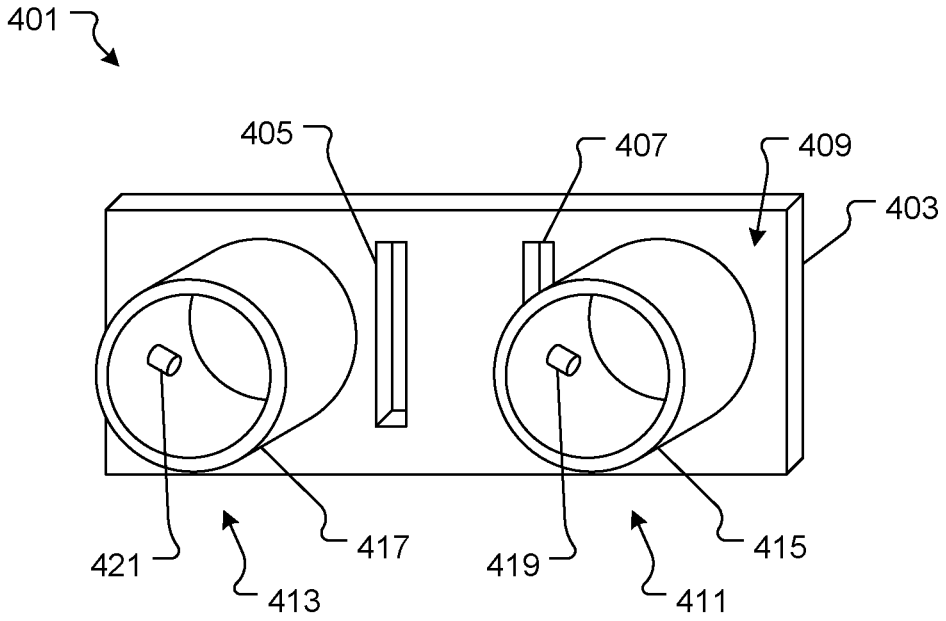
FIG. 4 is a perspective view of an adaptor holding device for the adaptor of FIG. 2.

Referring now to FIG. 4 a holder 401 for the adaptors 205 is depicted. Holder 401 having a body 403 with slots 405, 407 passing through from the front surface 409 to the back. The slots 405, 407 being configured to allow a strap, belt or the like to pass through tem and thus allow a user to carry the holder 401. The front surface 409 having multiple compartments 411, 413 attached to and extending away from it 409. Each compartment 411, 413 a housing 415, 417 and pin 419, 421 respectively.

It will be appreciated that each compartment 411, 413 is configured to hold an adaptor 205 in a similar fashion to the converter 203. It will also be appreciated that in this way many adaptors 205 could be carried with the user making the available for use with the firearm.

Figure 5:
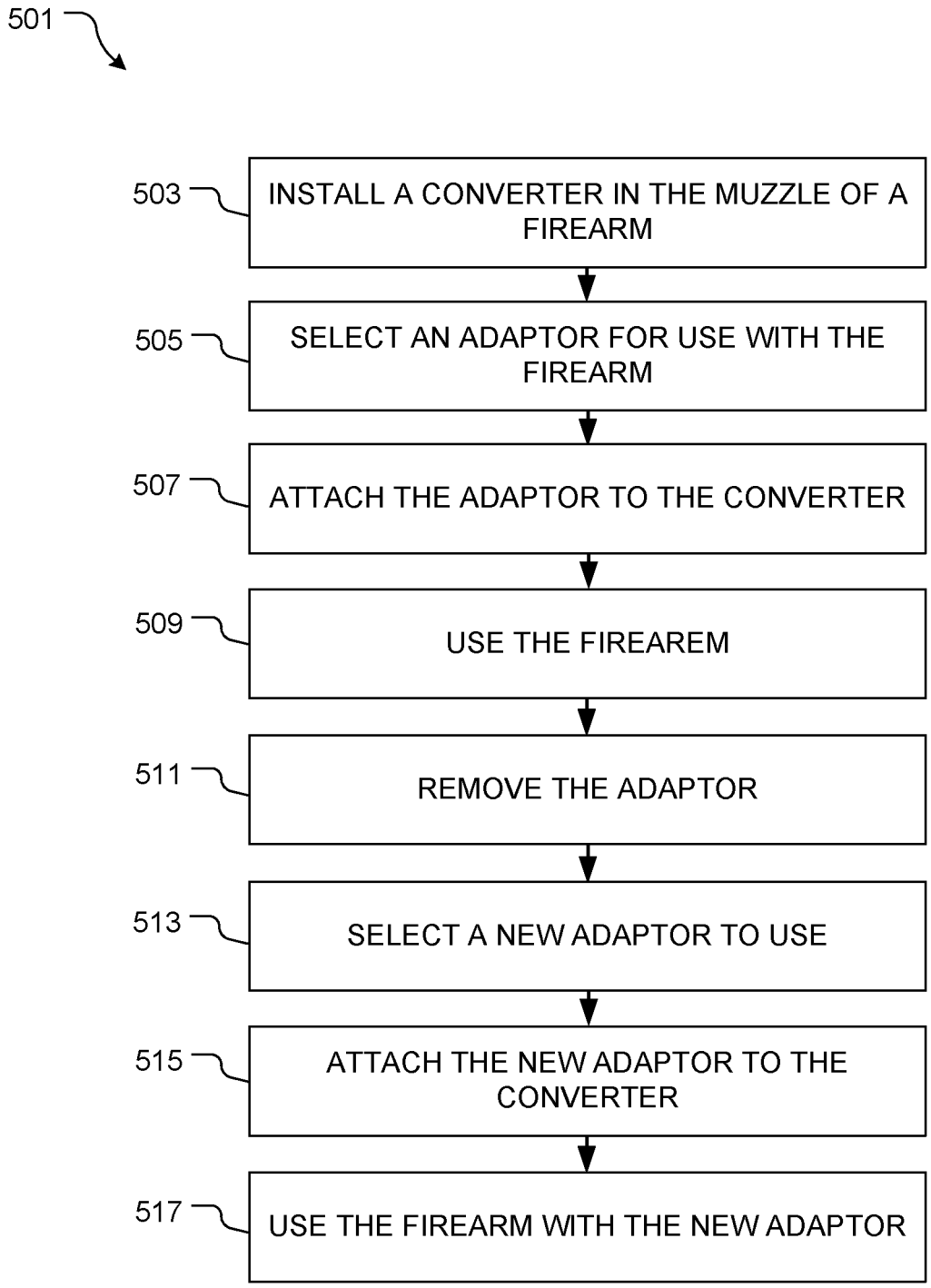
FIG. 5 is a flow chart of the preferred method of use of the system of FIG. 2.

Referring now to FIG. 5 the preferred method of use of system 201 is depicted. Method 501 including installing a converter in the muzzle of a firearm barrel 503, selecting an adaptor 505, attaching the adaptor to the converter 507, using the firearm 509, removing the adaptor 511, selecting an different adaptor to use 513, attaching the new adaptor 515 and using the firearm 517.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A muzzle system for a shotgun muzzle, the system comprising:

a converter that threadedly attaches to the shotgun muzzle, the converter having:

a body that extends from a first end to a second end;

a protruded threaded rod that extend from the first end, the protruded threaded rod threadedly engages within the shotgun muzzle;

an opening that extends inwardly from the second end; and a pin extending from an inner surface of the opening;

an adaptor, having:

an adapter body with an outer surface; and a release device grooved inwardly from the outer surface of the adapter body, the release device having a first section and a second section, the second section extending perpendicular and away from the first section, the release device receives and locks onto the pin via a twisting movement;

wherein the converter threadedly engages with the shotgun muzzle and the adaptor twistedly engages with the converter.

2. The system of claim 1 wherein the adaptor is a choke.

* * * * *